US006132231A

United States Patent [19]

Suzuki

[11] Patent Number: 6,132,231

[45] Date of Patent: Oct. 17, 2000

[54] LOCK DEVICE FOR ELECTRICAL CONNECTOR

[75] Inventor: Akio Suzuki, Tokyo, Japan

[73] Assignee: Hirose Electric Co., Ltd., Tokyo, Japan

[21] Appl. No.: 08/974,508

[22] Filed: Nov. 19, 1997

[30] Foreign Application Priority Data

Nov. 25, 1996 [JP] Japan ..... 8-328011

[51] Int. Cl.[7] ..... H01R 13/627

[52] U.S. Cl. ..... 439/352

[58] Field of Search ..... 439/352, 357, 439/350–8

[56] References Cited

U.S. PATENT DOCUMENTS 5,558,534 9/1996 Sarkady et al. ..... 439/352

FOREIGN PATENT DOCUMENTS 7-249453 9/1995 Japan .

*Primary Examiner*—Steven L. Stephan
*Assistant Examiner*—Eugene G. Byrd
*Attorney, Agent, or Firm*—Kanesaka & Takeuchi

[57] ABSTRACT

The lock member 6 is provided with a resilient arm 7 flexible in a plane parallel to the side faces of a housing body 2. A hook portion 8 is provided on the free end of the resilient arm 7. A cam follower 10 is provided on the resilient arm 7 for receiving a force from the release knob. The resilient arm 7 is guided by a guide face 5A so that it is flexible only in a plane parallel to the side face of the housing body. A cam section 13 with a tapered edge 10A is provided on the resilient arm 7 so that when the release knob 11 is squeezed, the cam section 13 presses the cam follower 10 downwardly.

4 Claims, 3 Drawing Sheets

LOCK DEVICE FOR ELECTRICAL CONNECTOR

BACKGROUND OF THE INVENTION

1. Field of the Invention

The present invention relates to lock devices for electrical connectors.

2. Description of the Related Art

Connectors having a flat housing body are widely used. The housing body is provided at the front portion with a fitting rectangular cylindrical section for fitting into a mating connector.

Such a connector is disclosed by Japanese patent application Kokai No. 249453/95. As shown in FIG. 6, the connector 50 of the flat type has a rectangular housing body 51 to be fitted into the housing 61 of a mating connector 60. A lock arm 52 extends rearwardly from the middle of an upper face of the housing body 51 and has a pair of extended sections 52A at the rear end. An engaging projection 52B is provided on the upper face of the lock arm 52. A pair of lock release walls 53 are provided on the rear upper face of the housing body 51. Each lock release wall 53 has a lock release face 54 and a fitting groove 55 below the lock release face.

An engaging ridge 62 is provided on the front inner face of the cylindrical section of the housing 61 of the mating connector 60.

When the housing body 51 of the connector 50 is inserted into the housing 61 of the mating connector 60, the engaging projection 52B of the lock arm 52 abuts against the engaging ridge 62 of the mating connector 60 so that the lock arm 52 is flexed downwardly to allow further advance of the housing body 51. When the engaging projection 52B passes the engaging ridge 62, the lock arm 52 snaps to the original position for making a lock to prevent separation of the connector 50 from the mating connector 60.

To remove the connector 50 from the mating connector 60, the lock release walls 53 are squeezed to flex them inwardly so that the extended sections 52A are pushed downwardly along the lock release faces 54 and retained in the fitting grooves 55. Thus, the engaging projection 52B is moved downwardly and released from the engaging ridge 62 of the mating connector 60. Under such conditions, the connector 50 is pulled out of the mating connector 60.

In the above connector, however, the lock release walls 53 project upwardly to a considerable extent, making the connector bulky. In addition, it is necessary to flex the lock release walls 53 to a sufficient amount to push down the extended sections 52A of the lock arm 52. This further elongates the lock release walls 53 and the connector.

The operation position of the lock release walls 53 is shifted from the center of the connector 50 so much that it is frequent to tilt the connector 50. Thus, removal of the connector will not be smooth.

SUMMARY OF THE INVENTION

Accordingly, it is an object of the invention to provide a lock device for electrical connector, which is compact, economical and able to provide stable release operation.

According to the invention, an electrical connector has a housing having a housing body and a rectangular cylindrical section extending forwardly from the housing body for fit into a mating connector. A pair of lock members are provided in the housing body such that hook portions project upwardly from the rectangular cylindrical section for engagement with the mating connector. A pair of release units are provided on opposite sides of the housing body for flexing the lock members so as to bring the hook portions to a retreated position.

A pair of resilient arms are provided on the lock members to be flexible in a plane parallel to the side faces of the housing body. A hook portion is provided on the free end of each resilient arm. A cam follower is provided the resilient arm to receive a force from the release unit. The resilient arm is guided by the guide face so as to flex in the plane parallel to the guide face. A cam section is provided on the release unit so that when the release unit is squeezed, it presses downwardly the resilient arm.

To remove the electrical connector from the mating connector, the release units are squeezed so that the cam sections press downwardly the cam followers of the resilient arms because the resilient arms are guided by the guide faces. Consequently, the hook portions of the resilient arms are released from the engagement with the mating connector so that the connector is removable from the mating connector.

DESCRIPTION OF THE PREFERRED EMBODIMENT

An embodiment of the invention will be described with reference to FIGS. 1–5.

Figure 1:
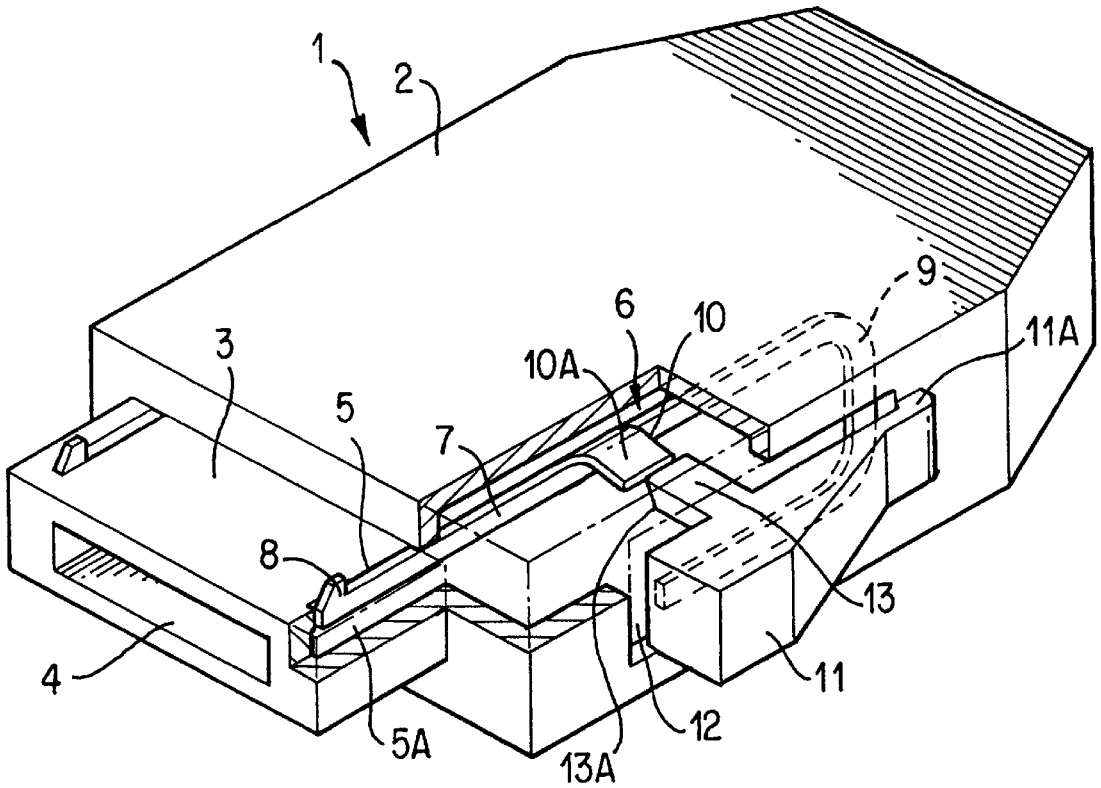
FIG. 1 is a partially cutaway perspective view of a connector according to an embodiment of the invention.

In FIG. 1, a housing 1 made of an insulating material has a housing body 2 and a rectangular cylindrical section 3. The housing body 2 has a flat rectangular shape, and the rectangular cylindrical section 3 projects from the front face of the housing body 2. A connection mouth 4 extends rearwardly from the front end of the cylindrical section 3 and, contact terminals (not shown) are arranged so as to contact the contact terminals of a mating connector when the connection mouth 4 receives the connection section of the mating connector (not shown).

A pair of guiding slit 5 with guiding faces 5A are provided in the upper face of the cylindrical section 3. The front portions of resilient arms 7 of lock members 6 made of a metal sheet are received in the guiding slits 5 such that hook portions 8 project upwardly from the guiding slits 5. The lock members 6 are accommodated in the cavity of the housing body 2. The lock members 6 are made by stamping a metal sheet so as to provide a resilient arm 7 having the hook portion 8, a U-shaped retention section 9, and a cam follower extending outwardly from the resilient arm 7. The retention section 9 is retained by the housing body 2 such that the resilient arm 7 is guided by the guide face 5A of the guiding section 5. Consequently, the resilient arm 7 is flexible only in a plane parallel to the guide face 5A. The cam follower 10 is curved downwardly to form a sloping face 10A.

A pair of release knobs 11 are provided on opposite side walls of the housing 1. An opening 12 is provided in a side wall of the housing body 2, and the base section 11A of the release knob 11 is provided on the housing body 2 at the rear edge of the opening 12 such that the release knob 11 covers substantially the entire area of the opening 12. The release knob 11 is flexible in a plane perpendicular to the side wall of the housing body 2.

A cam portion 13 extending inwardly from the release knob 11 and has a tapered front end 13A in the vicinity of the cam follower 10.

How to use the connector will be described below.

(1) To connect the connector to a mating connector, when the cylindrical section 3 is fitted into the receiving section of the mating connector, the hook portions 8 of the lock members 6 are pressed downwardly by the mating connector so that the resilient arms 7 are flexed downwardly. Then, the resilient arms 7 spring back so that the hook portions 8 engage the engaging portions (not shown) of the mating connector to prevent separation of the connector.

(2) To remove the connector from the mating connector, the release knobs 11 are squeezed toward the housing body 11.

(3) When the release knobs 11 are flexed at the base 11A, the tapered face 13A of the cam sections 13 presses downwardly the cam follower 10A.

(4) The resilient arms 7 are then pressed downwardly along the guide faces 5A.

(5) Thus, the hook portions 8 are released from the engagement with the mating connector so that the connector is removable from the mating connector.

Figure 2:
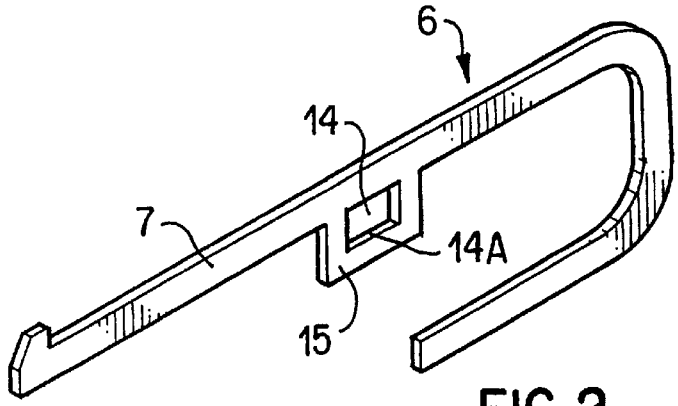
FIG. 2 is a perspective view of a lock member useful for the connector of FIG. 1.

In FIG. 2, the lock member 6 has an enlarged section 15 with a window portion 14 such that the lower edge of the window portion 14 forms a cam follower 14A. When the lock is released, the cam section 13 of the released knob 11 enters the window portion 14 so that the tapered face 13A of the cam section 13 presses downwardly the cam follower 14A of the window portion 14.

Another embodiment of the invention will be described with reference to FIGS. 3–5. In the embodiment, the pressure portion of a resilient arm is provided on the lock member.

Figure 3:
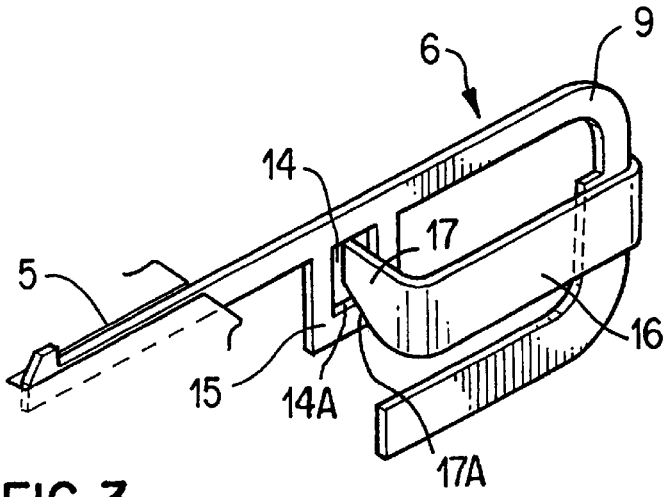
FIG. 3 is a perspective view of a lock member according to another embodiment of the invention.

In FIG. 3, as in FIG. 2, the cam follower 14A is a lower edge of the window portion 14, but a resilient piece 16 extends forwardly from the retention section 9. The free end of the resilient piece 16 is bent to provide a cam portion 17 having a tapered lower edge 17A. The cam portion 17 is held at such a position that the tapered lower edge 17A is in the vicinity of the cam follower 14A.

In this embodiment, the release knob 11 does not require such a cam portion 13 as shown in FIG. 1. The resilient pieces 16 are squeezed with or without the knobs 11. When the resilient pieces 16 are squeezed, the cam followers 14A are pressed downwardly by the cam portions 17. The upper edge of the window portion 14 may be omitted.

Figure 4:
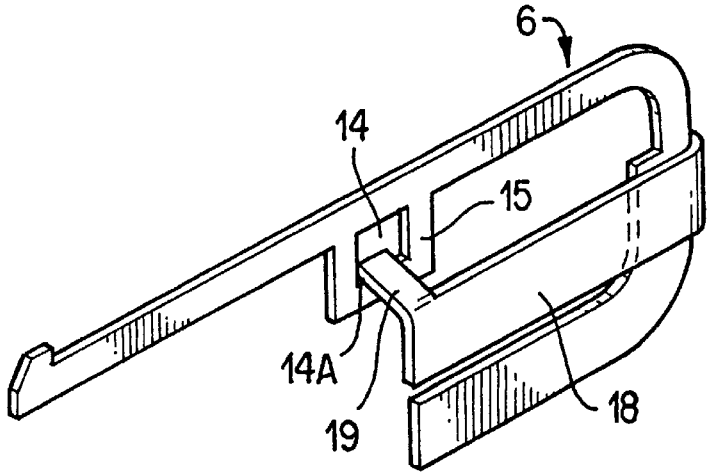
FIG. 4 is a perspective view of a lock member according to still another embodiment of the invention.
Figure 5:
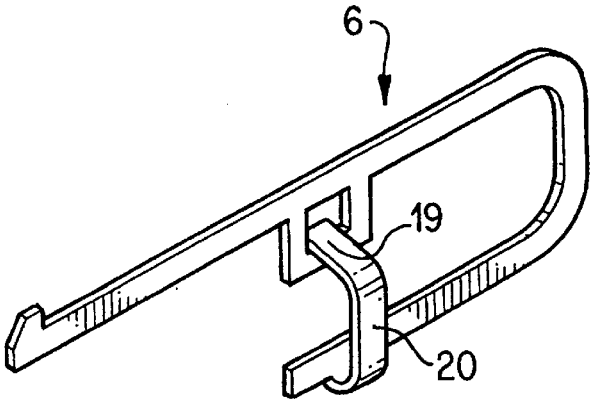
FIG. 5 is a perspective view of a lock member according to yet another embodiment of the invention.
Figure 6:
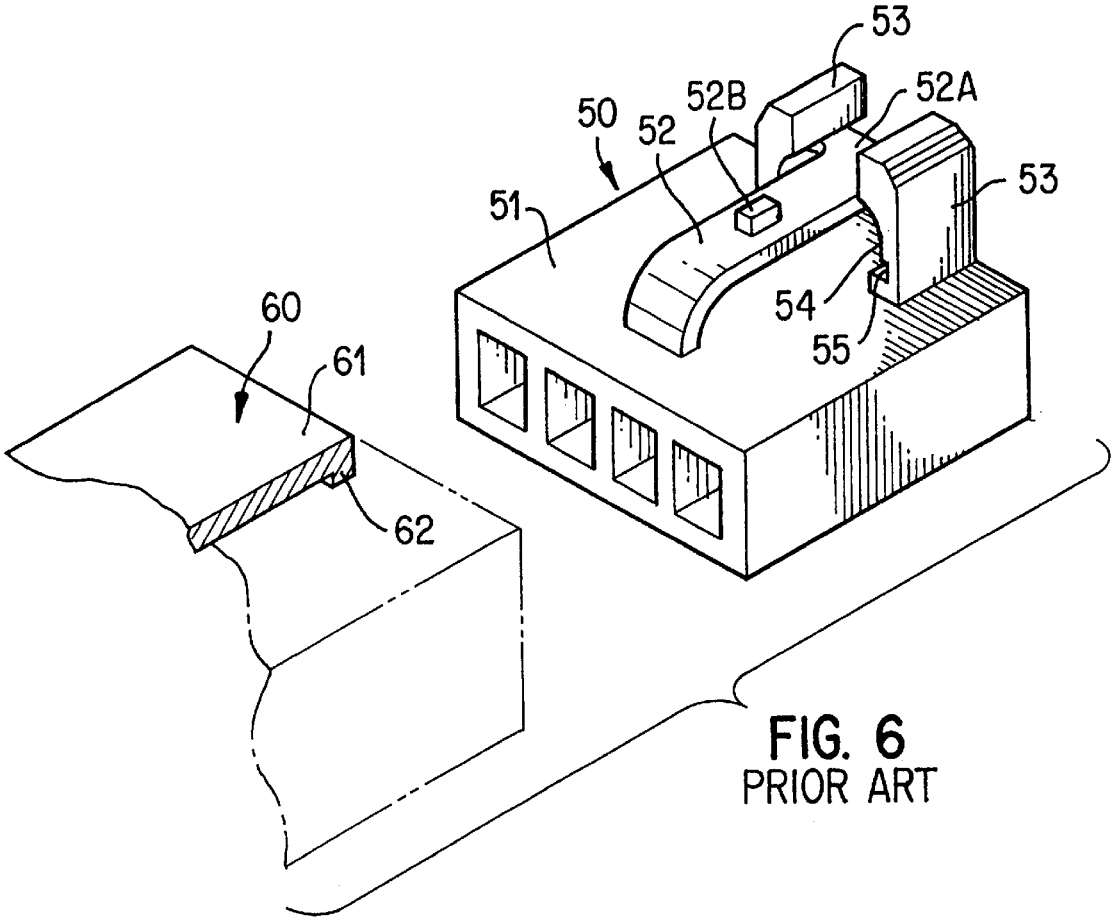
FIG. 6 PRIOR ART
FIG. 6 is a partially cutaway perspective view of a lock device of a conventional electric connector.

In FIG. 4, a cam face 19 extends inwardly from a resilient piece 18 so as to contact against the cam follower 14A. In FIG. 5, a resilient piece 20 extends upwardly from a lower arm 21 of the lock member 6.

As has been described above, the lock member are made flat, and lock and release operations are made in a plane parallel to the flat face while the lock release is made by the cam and cam follower which are movable in the plane perpendicular to the flat face so that the lock mechanism is made thin and compact. In addition, the hook portions for lock and release are movable to a large extent and the release knobs are squeezed with one hand so that stable operations are obtained. Moreover, the lock members are made by a simple process.

What is claimed is:

1. A lock device for an electrical connector, comprising:

a housing having a housing body and a rectangular cylindrical section which has upper, bottom, and side faces extending forwardly from said housing body for fit into a mating connector and at least one guide face parallel to said faces;

at least one lock member provided in said housing body having a resilient arm comprising a free end;

a hook portion provided on said free end so as to normally project from said upper face of said rectangular cylindrical section for engagement with said mating connector;

at least one release means for flexing said lock member so as to bring said hook portion into a retreated position;

a cam follower provided on said resilient arm for receiving a force from said release means; and a cam section provided on said release means so that when said release means is squeezed, said cam section presses said cam follower and flexes said hook portion in a direction different from a direction of movement of said release means for release of said lock member from said mating connector.

2. A lock device for an electrical connector according to claim 1, wherein said cam follower is curved to form a sloping face and said cam section has a front end tapered such that said cam section rides up said cam follower when said release means is squeezed.

3. A lock device for an electrical connector according to claim 1, wherein a part of said housing body prevents said hook portion and said lock member from moving in said direction of said movement of said release means.

4. A lock device for an electrical connector according to claim 1, wherein said lock member and said hook portion are flexed along said guide face in a plane parallel to said side faces.

* * * * *